US005301442A

United States Patent [19]

Williams

[11] Patent Number: 5,301,442

[45] Date of Patent: Apr. 12, 1994

[54] SQUARE-TOE ATTACHMENT FOR GOLF SHOES

[76] Inventor: H. Richard Williams, 1430 Oyster Point Dr., Sugar Land, Tex. 77478

[21] Appl. No.: 991,395

[22] Filed: Dec. 16, 1992

[51] Int. Cl.[5] ..... A43B 5/00

[52] U.S. Cl. ..... 36/127; 36/77 R; 36/132; 36/136

[58] Field of Search ..... 36/1, 7.2, 7.7, 8.3, 36/72 R, 77 R, 96, 113, 127, 132, 133, 136

[56] References Cited

U.S. PATENT DOCUMENTS

| | | | |
|---|---|---|---|
| 1,515,665 | 11/1924 | Eck | 36/132 |
| 1,684,442 | 9/1928 | Haney | 36/8.3 |
| 2,782,531 | 2/1957 | Frazier et al. | 36/133 |
| 2,810,214 | 10/1957 | Wolfe | 36/96 |
| 2,881,539 | 4/1959 | Dysart | 36/72 R |
| 3,851,410 | 12/1974 | Frazier | 36/133 |
| 4,407,079 | 10/1983 | Chiroff | 36/127 |
| 4,693,022 | 9/1987 | Terhune | 36/136 |

OTHER PUBLICATIONS

Journal of American Medical Accos. (AMA) vol. 168 No. 7 Oct. 18, 1958.

*Primary Examiner*—Paul T. Sewell
*Assistant Examiner*—M. D. Patterson
*Attorney, Agent, or Firm*—Kenneth A. Roddy

[57] ABSTRACT

A square-toe attachment for removable attachment to the front portion of the golf shoe farthest from the golfer's target. The attachment has a generally U-shaped configuration with sides which engage the inside and outside of the sole of the shoe and a rectangular front toe portion with a generally flat front wall disposed forward of the toe of the golf shoe and generally perpendicular to the bottom of the shoe which causes the golfer's foot farthest from the target to assume a generally vertical position with the heel up and toe down during the follow-through phase of a golf swing. The attachment is removably attached to the shoe by flexible straps with hook and loop fastener material which extend over the top of the shoe and is releasably secured to the bottom of the sole of the shoe by at least one of the shoe spikes. During the follow-through phase of the golf swing, as the heel of the shoe is raised during weight transfer, the attachment causes the foot to assume a generally vertical "toe-down, heel-up" position with only the toe portion of the shoe in contact with the ground. Thus, the position of the foot farthest from the target at the follow-through phase of the swing, automatically causes the golfer to shift their weight toward the target, to flex the back knee moving it very close or even to touch the front knee, and to turn the hips toward the target.

1 Claim, 2 Drawing Sheets

SQUARE-TOE ATTACHMENT FOR GOLF SHOES

BACKGROUND OF THE INVENTION

1. Field of the Invention

This invention relates generally to golf shoe attachments, and more particularly to a square-toe attachment which is releasable attached to the shoe of a golfer to aid the golfer in assuming the correct foot position in the follow-through phase of a golf swing.

2. Brief Description of the Prior Art

In a correct golf swing, a transfer of weight distribution begins to the inside of the back leg and foot (farthest from the target). About half way through the back swing, the main weight is transferred to the inside of the back leg and foot and the hips turn automatically with the weight transfer. At the top of the backswing and before the start of the down swing, most of the weight is principally on the ball of the back foot. At the start of the down swing, a transfer of weight begins from the inside of the back leg and ball of the foot to the forward leg and ball of the foot (closest to the target) so as to drive the with the legs and the turn of the hips. At the completion or "follow-through" phase of the swing, most of the weight should have been transferred to the forward leg and ball of the foot (closest to target).

However, at the completion or "follow-through" phase of a golf swing, many golfers remain flat footed or fail to assume the proper foot position. In the proper "follow-through", the golfer should: (1) shift his or her weight toward the target, (2) touch the back knee (farthest from the target) to the front knee (closest to the target), and (3) turn the hips toward the target. These details are often forgotten, or never properly learned, but if practiced routinely, will improve the golf swing and result in greater accuracy and a more powerful swing.

At the end of the follow-through, most professional golfers will have the heel of their back foot (farthest from target) raised with only the toe portion of their shoe in contact with the ground, rather than just slightly pivoting the back foot or leaving the ball of the foot on the ground. This raised heel foot position is the position that the foot would finish if the three items listed above were executed properly and the weight was completely transferred.

There are several patents which disclose various golf shoe attachments, none of which would aid the golfer in raising the heel of their back foot (farthest from target) and placing the toe portion of their shoe in contact with the ground at the end of the follow-through.

Frisch et al, U.S. Pat. No. 3,755,929 and Latto, U.S. Pat. No. 3,866,339 disclose plate devices which have a series of depending spikes and are removably attached to the heel and sole of a pair of street shoes to convert the street shoes into golfing shoes.

Chiroff, U.S. Pat. No. 4,407,079 discloses a roll bar device having an arcuate surface mounted on the metatarsal portion of the forward shoe (closest to target) which slopes toward the outside edge of the sole for assisting the pivot of the foot closest to the target during the follow-through of the golf swing. This device flexes the forward knee and pivots the forward foot and would hinder the correct weight transfer as discussed above.

O'Brien, U.S. Pat. No. 4,073,075 discloses a detachable wedge-shaped device slidably mounted by pins in holes in the outer side of the sole at the metatarsal portion of the back shoe (farthest from the target) for forcing an inward tilt of the back shoe and a proper knee position. The device is adapted to be secured to conventional golf shoes, street shoes, and sport shoes which are modified to receive the sole engaging mounting pins.

Davis, U.S. Pat. No. 4,819,940 discloses a wedge-shaped bar which is attached along the outside edge of the bottom of the back shoe (farthest from the target) and causes the back shoe to tilt or slant inwardly and forwardly simultaneously. The wedge-shaped bar slopes inward toward the centerline of the foot and also slopes forward from the heel toward the ball of the foot.

The present invention is distinguished over the prior art in general, and these patents in particular by a square-toe attachment for removable attachment to the front portion of the golf shoe farthest from the golfer's target. The attachment has a generally U-shaped configuration with sides which engage the inside and outside of the sole of the shoe and a rectangular front toe portion with a generally flat front wall disposed forward of the toe of the golf shoe and generally perpendicular to the bottom of the shoe which causes the golfer's foot farthest from the target to assume a generally vertical position with the heel up and toe down during the follow-through phase of a golf swing. The attachment is removably attached to the shoe by flexible straps with hook and loop fastener material which extend over the top of the shoe and is releasably secured to the bottom of the sole of the shoe by at least one of the shoe spikes. During the follow-through phase of the golf swing, as the heel of the shoe is raised during weight transfer, the attachment causes the foot to assume a generally vertical "toe-down, heel-up" position with only the toe portion of the shoe in contact with the ground. Thus, the position of the foot farthest from the target at the follow-through phase of the swing, automatically causes the golfer to shift their weight toward the target, to flex the back knee moving it very close or even to touch the front knee, and to turn the hips toward the target.

SUMMARY OF THE INVENTION

It is therefore an object of the present invention to provide a square-toe attachment which is releasable attached to the shoe of a golfer to aid the golfer in assuming the correct foot position in the follow-through phase of a golf swing.

It is another object of this invention to provide a square-toe attachment for golf shoes which will allow the heel of the foot farthest from the target to be raised with only the toe portion of the foot in contact with the ground during the follow-through phase of a golf swing.

Another object of this invention is to provide a square-toe attachment for golf shoes which will allow the heel of the foot farthest from the target to be raised with only the toe portion.

Another object of this invention is to provide a square-toe attachment for golf shoes which will assist the golfer in automatically shifting their weight toward the target, turning the knee farthest from the target toward the knee closest to the target, and turning the hips toward the target.

Another object of this invention is to provide a square-toe attachment for golf shoes which is easily and quickly installed on and removed from conventional golf shoes.

A still further object of this invention is to provide a square-toe attachment for golf shoes which is simple in construction, economical to manufacture and rugged and durable in use.

Other objects of the invention will become apparent from time to time throughout the specification and claims as hereinafter related.

The above noted objects and other objects of the invention are accomplished by a square-toe attachment for removable attachment to the front portion of the golf shoe farthest from the golfer's target. The attachment has a generally U-shaped configuration with sides which engage the inside and outside of the sole of the shoe and a rectangular front toe portion with a generally flat front wall disposed forward of the toe of the golf shoe and generally perpendicular to the bottom of the shoe which causes the golfer's foot farthest from the target to assume a generally vertical position with the heel up and toe down during the follow-through phase of a golf swing. The attachment is removably attached to the shoe by flexible straps with hook and loop fastener material which extend over the top of the shoe and is releasably secured to the bottom of the sole of the shoe by at least one of the shoe spikes. During the follow-through phase of the golf swing, as the heel of the shoe is raised during weight transfer, the attachment causes the foot to assume a generally vertical "toe-down, heel-up" position with only the toe portion of the shoe in contact with the ground. Thus, the position of the foot farthest from the target at the follow-through phase of the swing, automatically causes the golfer to shift their weight toward the target, to flex the back knee moving it very close or even to touch the front knee, and to turn the hips toward the target.

DESCRIPTION OF THE PREFERRED EMBODIMENT

Figure 1:
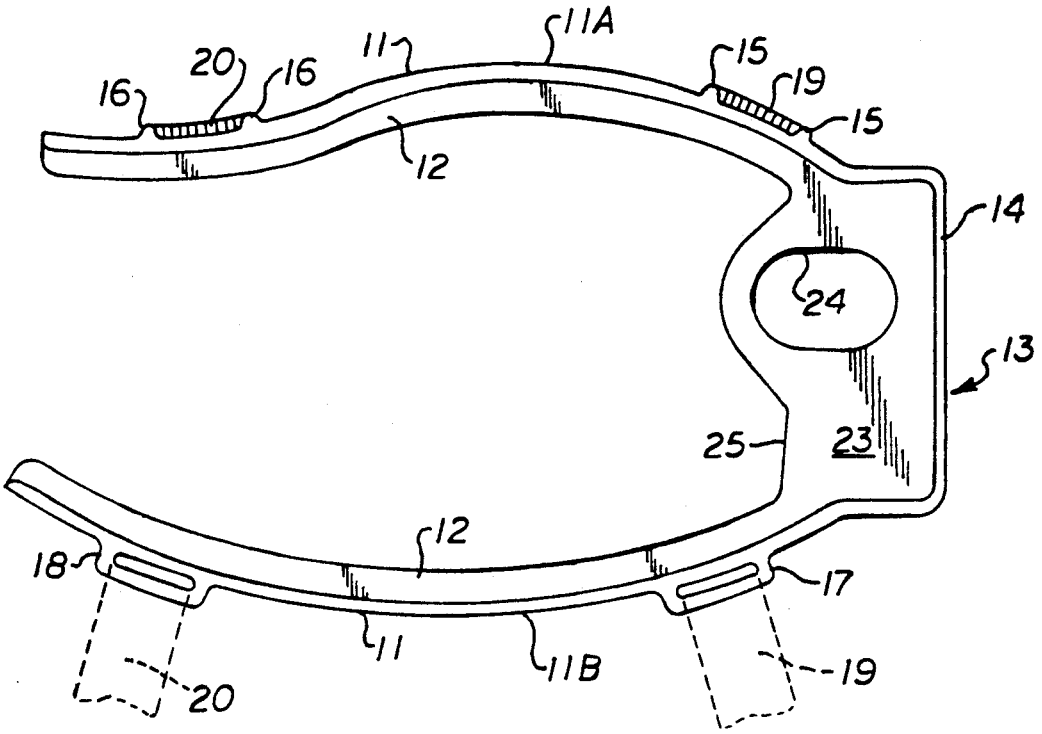
FIG. 1 is a top plan view of the square-toe attachment for golf shoes in accordance with the present invention.
Figure 2:
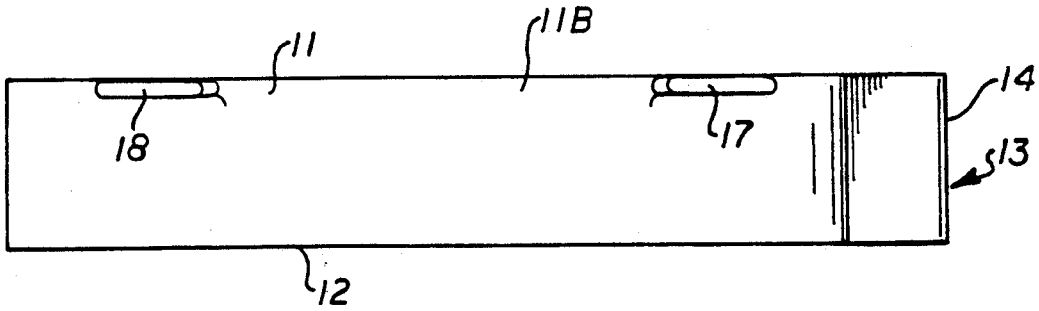
FIG. 2 is a side elevation of the square-toe attachment for golf shoes.

Referring to the drawings by numerals of reference, there is shown in FIGS. 1 and 2, a preferred square-toe attachment 10 for golf shoes. The attachment 10 is a generally U-shaped member, preferably formed of substantially rigid lightweight plastic material. The attachment 10 is generally L-shaped in cross section and has a vertical side wall 11 and horizontal bottom wall 12. The side wall 11 has opposed sides 11A and 11B which are curved corresponding generally to the shape of the front sole portion of a conventional golf shoe. At the front or toe portion of the attachment 10, the side wall 11 extends outwardly from the curved portion in the form of a generally rectangular toe extension 13 which has a generally vertical front wall 14. The curved sides 11A and 11B extend rearwardly from the toe extension 13 and engage the inner and outer sides of the metatarsal portion of the conventional golf shoe.

Figure 3:
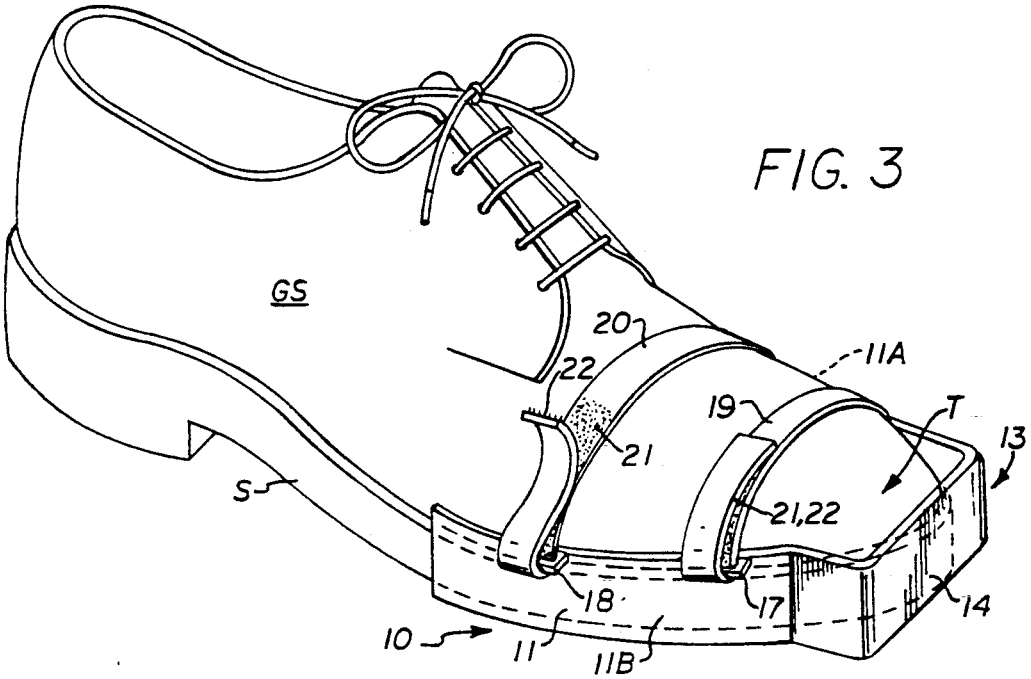
FIG. 3 is a perspective view of a golf shoe having the square-toe attachment installed thereon.

A first pair of small protrusions 15 are formed in side 11A of the side wall 11 near the rectangular toe extension 13, and a second pair of small protrusions 16 are formed in the side 11A near the open end of the U-shaped attachment 10. A first rectangular eyelet 17 extends outwardly from side 11B of the side wall 11 near the rectangular toe extension 13, and a second rectangular eyelet 18 extends outwardly from side 11B near the open end of the U-shaped attachment 10. A first flexible strap 19 is secured to the side 11A between the protrusions 15 and a second flexible strap 20 is secured to side 11A between the protrusions 16. As best seen in FIG. 3, the flexible straps 19 and 20 extend over the top of the golf shoe GS and through the respective eyelets 17 and 18. The surfaces of the straps 19 and 20 are provided with mating hook and loop fasteners 21 and 22 so that each strap can be pulled tight and then looped over the eyelets and secured on itself.

Figure 4:
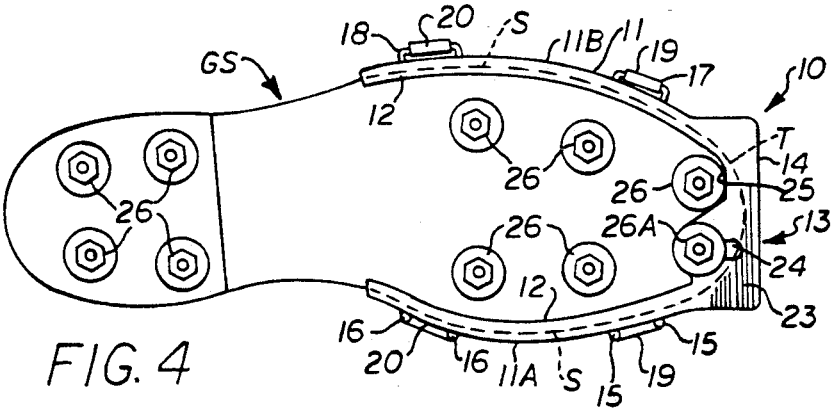
FIG. 4 is a bottom plan view of the golf shoe having the square-toe attachment installed thereon.

As best seen in FIGS. 1 and 4, the horizontal bottom wall 12 has a narrow width which extends a short distance inwardly from the opposed sides 11A and 11B and generally follows the curvature corresponding generally to the shape of the front sole portion of the conventional golf shoe GS. At the front or toe portion of the attachment 10, the bottom wall 12 extends inwardly from the generally rectangular toe extension 13 to form a wide platform portion 23. The platform portion 23 has an aperture 24 formed therein near one side and a cutaway portion 25 laterally spaced to one side of the aperture.

As seen in FIGS. 3 and 4, the attachment 10 is removably installed on a conventional golf shoe GS having a plurality of spikes 26 by removing the toe spike 26A corresponding to the location of the aperture 24 from the bottom of the shoe. The attachment 10 is then installed on the front portion of the golf shoe GS by sliding it onto the front portion of the shoe. In the installed position, the curved sides 11A and 11B of side wall 11 conform generally to the outer periphery of the inner and outer sides of the metatarsal portion of the shoe sole S at the front end of the golf shoe GS and the generally rectangular toe extension 13 extends forwardly a short distance from the toe portion T of the shoe. The horizontal platform portion 23 is engaged on the bottom of the shoe sole. The threaded shank of the toe spike 26A which was previously removed is placed through the aperture 24 and then tightened down to clamp the platform portion 23 onto the bottom B of the shoe GS. The cutaway portion 25 of the platform is configured to clear the adjacent toe spike.

The flexible straps 19 and 20 are placed over the top of the golf shoe GS and through the respective eyelets 17 and 18, looped over and then secured on themselves by engaging the loop and hook fasteners 21 and 22. When installed, the attachment 10 will not interfere with normal walking.

It should be understood, that although the illustrated embodiment of the square-toe attachment is configured for the right shoe, for right-handed golfers, the attachment for left-handed golfers would be substantially a mirror image of that shown. It should also be understood that the attachment may produced without the aperture 24 and installed on the shoe without connecting it to the sole with the spike.

OPERATION

After the square-toe attachment to is installed on the proper shoe (right shoe for right-handed golfers or left shoe for left-handed golfers), the golfer aligns their body and address the ball in the conventional manner. About half way through the back swing, the major portion of the golfer's weight is transferred to the inside of the back leg and foot (farthest from target) and the hips are turned with the weight transfer. At the top of the backswing and before the start of the down swing, most of the weight should be principally on the ball of the back foot.

Figure 5:
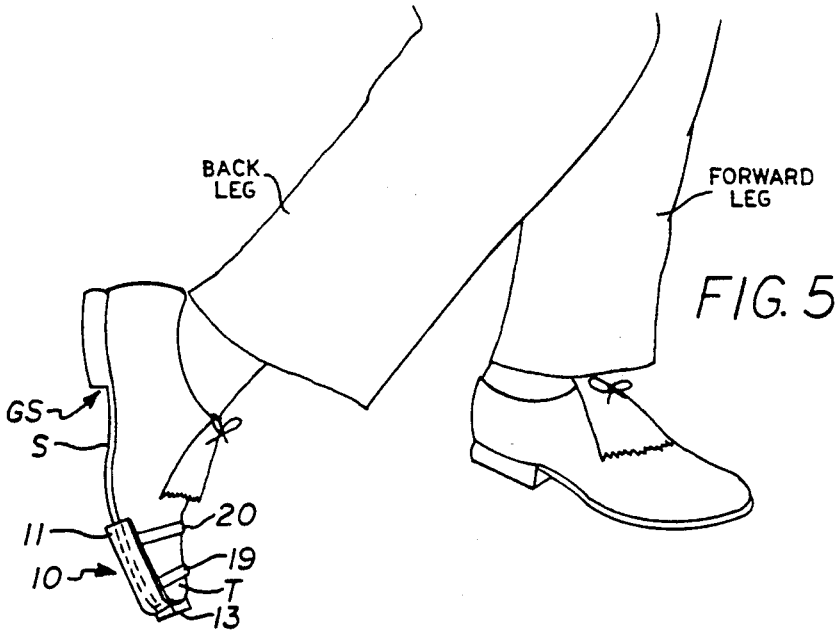
FIG. 5 is a partial perspective view of the legs of a golfer assuming the follow-through position with the square-toe attachment installed on the right shoe.

At the start of the down swing, the weight should be transferred beginning from the inside of the back leg and ball of the foot to the forward leg and ball of the foot (closest to the target) so as to drive the with the legs and the turn of the hips. At the "follow-through" phase of the swing, the heel of the back foot should be raised as the weight is transferred to the forward leg and ball of the foot closest to target (FIG. 5). The square-toe attachment 10 will prevent the golfer from remaining flat-footed or from just slightly pivoting the back foot. As the heel of the shoe is raised during weight transfer, the rigid attachment 10 automatically causes the foot to assume a generally vertical "toe-down, heel-up" position with only the toe portion of their shoe in contact with the ground. This position of the foot farthest from the target at the follow-through phase of the swing, will automatically cause the golfer to shift his or her weight toward the target, to flex the back knee moving it very close or even to touch the front knee, and to turn the hips toward the target.

The square-toe attachment assures proper back foot position during the follow-through phase of the swing and if worn during practice sessions, as a teaching or practice tool, will eventually develop muscle memory and improve the golf swing and result in greater accuracy and a more powerful swing.

While this invention has been described fully and completely with special emphasis upon a preferred embodiment, it should be understood that within the scope of the appended claims the invention may be practiced otherwise than as specifically described herein.

I claim:

1. A square-toe attachment device for removable attachment to the front portion of the sole of a conventional golf shoe of the type having a plurality of spikes threaded into the bottom of the sole thereof, the attachment device comprising:

a substantially rigid generally U-shaped attachment member having a flat generally rectangular vertical front wall portion and a pair of opposed curved vertical side wall portions extending rearwardly from said generally rectangular vertical front wall portion, said side wall portions curved in the shape of the inner and outer periphery of the metatarsal portion of the sole of the golf shoe farthest from the golfer's target, said flat generally rectangular front wall portion and said vertical side wall portions each having a generally L-shaped cross section with a vertical side wall and horizontal bottom wall and said horizontal bottom wall extending a short distance inwardly from said opposed side wall portions and said generally rectangular front portion vertical wall to engage the bottom of the sides and front portion of the sole of the golf shoe to position said flat generally rectangular vertical front wall portion generally perpendicular to the bottom of the golf shoe, said horizontal bottom wall extending inwardly a sufficient distance and having an aperture to receive the threaded shank of at least one spike and said horizontal bottom wall is releasably secured on the bottom of the sole of the golf shoe at the toe end by at least one spike having a threaded shank extending through said aperture and threadedly engaged in the bottom of the sole of the golf shoe, first eyelet means on said vertical side wall portions near said generally rectangular front wall portion and second eyelet means on said vertical side wall portions near the open end of the U-shape, and a first flexible strap connected with said first eyelet means to be fastened over the upper toe portion of the golf shoe and a second flexible strap connected with said second eyelet means to be fastened over the upper instep portion of the golf shoe and each said strap having mating hook and loop fastener means thereon for releasably attaching said attachment member to the golf shoe, and said at least one spike and said first flexible strap at the toe portion and said second strap at the instep portion and said curved side wall portions at the metatarsal portion of the golf shoe secure said attachment member to the golf shoe and stiffen the metatarsal portion of the sole of the golf shoe to prevent the toe portion of the golf shoe from bending, such that during the follow-through stage of a golf swing, as the golfer's weight is transferred from the foot farthest from the target to the foot closest to the target and the heel of the foot farthest from the target is raised, the stiffened metatarsal portion of the golf shoe and the flat generally rectangular front wall portion of said attachment member causes the golfer's foot farthest from the target to automatically assume a generally vertical position with the heel up and toe down and the golfer's knee bent with only the flat generally rectangular front wall portion of said attachment member in contact with the ground to facilitate a proper weight transfer and follow-through foot position.

* * * * *